US011530577B2

(12) United States Patent
Brooks

(10) Patent No.: US 11,530,577 B2
(45) Date of Patent: Dec. 20, 2022

(54) DRILL BIT FOR BORING EARTH AND OTHER HARD MATERIALS

(71) Applicant: Ulterra Drilling Technologies, L.P., Fort Worth, TX (US)

(72) Inventor: Nathan Andrew Brooks, Slade Point (AU)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 16/881,527

(22) Filed: May 22, 2020

(65) Prior Publication Data

US 2021/0156203 A1 May 27, 2021

Related U.S. Application Data

(63) Continuation of application No. PCT/AU2019/051292, filed on Nov. 26, 2019.

(51) Int. Cl.

| | |
|---|---|
| ***E21B 10/62*** | (2006.01) |
| ***E21B 10/42*** | (2006.01) |
| ***E21B 10/50*** | (2006.01) |
| ***E21B 10/52*** | (2006.01) |
| ***E21B 10/633*** | (2006.01) |

(52) U.S. Cl.
CPC ..... *E21B 10/62* (2013.01); *E21B 10/42* (2013.01); *E21B 10/50* (2013.01); *E21B 10/52* (2013.01); *E21B 10/633* (2013.01)

(58) Field of Classification Search
CPC ..... E21B 10/62; E21B 10/42; E21B 10/50
See application file for complete search history.

(56) References Cited

U.S. PATENT DOCUMENTS

| | | | | |
|---|---|---|---|---|
| 2,085,941 | A * | 7/1937 | Arnold | E21B 17/046 175/417 |
| 4,083,415 | A * | 4/1978 | Kita | E21B 10/38 173/132 |
| 5,624,002 | A | 4/1997 | Huffstutler | |
| 8,079,431 | B1 | 12/2011 | Cooley et al. | |
| 9,127,517 | B2 * | 9/2015 | Dupal | E21B 17/046 |
| 2006/0118298 | A1 | 6/2006 | Millar et al. | |
| 2010/0108391 | A1 | 5/2010 | Runia | |
| 2011/0101629 | A1 | 5/2011 | Wienhold | |
| 2012/0273281 | A1 | 11/2012 | Burhan et al. | |

(Continued)

FOREIGN PATENT DOCUMENTS

| | | |
|---|---|---|
| WO | 2008125108 | 10/2008 |

OTHER PUBLICATIONS

International Application No. PCT/AU2019/051292, International Preliminary Report on Patentability, dated Jul. 2, 2020, 9 pages.

(Continued)

*Primary Examiner* — D. Andrews
(74) *Attorney, Agent, or Firm* — Kilpatrick Townsend & Stockton LLP

(57) ABSTRACT

The present disclosure provides a cutting head adapted to removably couple to a bit body of a drill bit assembly. The cutting head includes a leading cutting tip for cutting into earth and a trailing receiving portion for receiving a second end of the bit body in an internal cavity defined by the trailing receiving portion to allow the cutting head to be removably coupled to the second end of the bit body.

18 Claims, 4 Drawing Sheets

(56) References Cited

U.S. PATENT DOCUMENTS

| | | | |
|---|---|---|---|
| 2015/0060149 | A1 | 3/2015 | Herman et al. |
| 2015/0322727 | A1 | 11/2015 | Do et al. |
| 2016/0084010 | A1 | 3/2016 | Beaton et al. |

OTHER PUBLICATIONS

International Application No. PCT/AU2019/051292, International Search Report and Written Opinion, dated Mar. 16, 2020, 12 pages.
European Application No. EP19889419.8, Extended European Search Report, dated Jun. 29, 2022, 7 pages.

* cited by examiner

DRILL BIT FOR BORING EARTH AND OTHER HARD MATERIALS

RELATED APPLICATIONS

This application is a continuation of Patent Cooperation Treaty (PCT) application no. PCT/AU2019/051292, filed Nov. 26, 2019, which is incorporated by reference herein in its entirety.

TECHNICAL FIELD

The present invention relates to drill bits used to bore through earth, concrete and other hard materials.

BACKGROUND

Any references to methods, apparatus or documents of the prior art are not to be taken as constituting any evidence or admission that they formed, or form part of the common general knowledge.

Specialized drill bits are used to drill wellbores, boreholes, and other holes in the earth for a variety of purposes, including water wells, oil and gas wells, injection wells, geothermal wells, monitoring wells, holes used in mining, and the like. These drill bits come in two common types: roller cone drill bits and fixed cutter drill bits.

Well bores and other holes in the earth are typically drilled by attaching or connecting a drill bit to a means of rotating the drill bit. The drill bit can be attached directly to a shaft that is rotated by a motor, engine, drive, or other means of providing torque to rotate the drill bit. In oil and gas drilling, for example, the drill bit is typically connected to the lower end of a drill string that is in turn, connected at the upper end to a motor or drive at the surface, with the motor or drive rotating both the drill string and the drill bit together. The drill string typically comprises several elements that may include a special down-hole motor configured to provide additional or, if a surface motor or drive is not provided, the only means of turning the drill bit.

Fixed cutter drill bits typically include a plurality of cutters, such as very durable polycrystalline diamond compact (PDC) cutters, tungsten carbide cutters, natural or synthetic diamond, or combinations thereof. These bits are referred to as fixed cutter bits because they employ cutting elements positioned on one or more fixed blades in selected locations or randomly distributed. Fixed cutter bits slide against the formation to remove the rock through a shearing operation. Through varying improvements, the durability of fixed cutter bits has improved sufficiently to make them cost effective in terms of time saved during the drilling process when compared to the higher up-front cost to manufacture the fixed cutter bits.

There exists a need for a cost-effective and robust drill bit that can better drill through a variety of natural and/or man-made formations or objects, including earth, steel, aluminium, concrete, cast iron, and other hard materials. It is also desirable to provide a drill bit that is readily serviceable.

SUMMARY

In one aspect, the invention provides a drill bit assembly for drilling a hole through earth, the drill bit comprising: a bit body extending between a first end and a second end along a longitudinal axis of the bit body with a connecting arrangement positioned at the first end of the bit body for coupling the bit body to a rotating shaft for providing rotational torque to the bit body; a cutting head including a leading tip portion for cutting into earth and a trailing receiving portion for receiving the second end of the bit body in an internal cavity defined by the receiving portion to allow the cutting head to be removably coupled to the second end of the bit body; and a retaining arrangement to retain the second end of the bit body in the receiving portion of the cutting head.

In an embodiment, the bit body comprises a stop member positioned along an outer wall of the bit body to limit axial movement of the receiving portion of the cutting head towards the first end of the bit body thereby engaging the retaining arrangement. In an embodiment, the stop member may be profiled to form a circumferential stop member to engage with the receiving portion of the cutting ahead and limit axial movement.

In an embodiment, the connecting arrangement comprises helical threads provided along an outer wall portion at or adjacent the first end of the bit body to couple the bit body to a rotating shaft for providing rotational torque to the bit body.

In an embodiment, the tip portion of the cutting head comprises a polycrystalline diamond compact (PDC) material.

In an embodiment, the bit body further comprises a bore extending from the first end to the second end along the longitudinal axis of the bit body, the bore being provided to convey a lubricant to the second end of the bit body.

In an embodiment, the second end of the bit body includes a lubricant releasing arrangement to release the lubricant into an internal cavity of the cutting tip thereby lubricating the bearing surfaces of the second end of the bit body and internal bearing surfaces of the cutting tip.

In an embodiment, the drill bit assembly further comprises: a filling lubricant nipple positioned at the first end of the bit body; and a release nipple positioned at the second end of the bit body.

In an embodiment, the retaining arrangement further comprises a split ring member, wherein an inner portion of the split ring member is adapted to be positioned and engaged in a groove provided along an outer wall of the bit body and an outer portion of the split ring is adapted to engage an inner groove provided along an inner wall of the receiving portion of the cutting head.

In an embodiment, the split ring comprises first and second circumferential end points that do not connect.

The cutting head may be push fitted into the bit body by effecting relative axial movement between the cutting head and the bit body such that the receiving portion of the cutting head received the second end of the bit body and the axial movement results in the inner groove of the cutting head being positioned in engagement with the split ring thereby resulting in the second end of the bit body being retained in the receiving portion of the cutting head.

In an alternative embodiment, the retaining arrangement comprises a detent assembly for detachably interlocking the cutting head and the bit body.

In an embodiment, the detent assembly comprises: a detent groove positioned along an inner wall of the receiving portion that defines the internal cavity for receiving the second end of the bit body; a detent provided at or adjacent the second end of the bit body along an outer wall of the bit body; wherein axial movement of the receiving portion of the cutting head towards the first end of the bit body results in engagement and retention of the detent within the detent groove.

In an embodiment, the bit body comprises a hollow passage for receiving a spring loaded pin member that forms part of the retaining arrangement.

In an embodiment, the pin member is biased by a spring member for movement towards the first end of the bit body.

In an embodiment, the drill bit assembly further comprises a cap member to retain the pin member within the hollow passage of the bit body and limit movement of the pin member in a direction towards the first end of the bit body.

In an embodiment, the pin member comprises: a head portion adapted to be positioned adjacent the first end of the bit body; a tail portion adapted to be positioned adjacent the second end of the bit body; and a pin body portion extending between the head and tail portions of the pin member.

In an embodiment, the tail portion is narrower than the pin body portion to accommodate a resilient member (such as helical spring) in between outer walls of said tail portion of the pin member and inner walls of the bit body defining said hollow cavity.

In an embodiment, the resilient member urges against a shoulder of the pin body portion to apply said resilient bias on the pin member.

In an embodiment, the hollow cavity of the bit body comprises a narrower throat portion extending towards the second end and wherein axial movement of the pin member towards the second end of the bit body by application of force against the resilient bias of the resilient member results in the cutting head being uncoupled from the bit body by releasing the retaining arrangement.

In an embodiment, the pin member comprises a notch positioned on the pin body such that the axial movement of the pin member towards the second of the bit body results in the notch being axially displaced and become positioned adjacent said detent assembly thereby allowing said detent to be received into the notch and be released from the detent hole of the cutting body.

In an embodiment, the cutting head is movably mounted relative to the bit body. Preferably, the cutting head is rotatably mounted relative to the bit body.

In another aspect, the invention provides a cutting head adapted to removably couple to a bit body of a drill bit assembly, the cutting head including a leading cutting tip for cutting into earth and a trailing receiving portion for receiving a second end of the bit body in an internal cavity defined by the trailing receiving portion to allow the cutting head to be removably coupled to the second end of the bit body.

In an embodiment, the leading cutting tip further comprises a tip portion and the tip portion comprises a polycrystalline diamond compact (PDC) material.

In an embodiment, the leading cutting tip is substantially frusto-conical.

In an embodiment, the tip portion comprises a PDC insert forming an apex portion of the substantially frusto-conical leading cutting tip.

In an embodiment, the cutting head further comprises a stop member portion to limit axial movement of the trailing receiving portion of the cutting head along the bit body.

In an embodiment, the stop member surrounds an opening of the internal cavity to limit axial movement of the trailing receiving portion of the cutting head along the bit body.

In an embodiment, the trailing receiving portion further comprises an inner groove provided along an inner wall thereof configured to receive a portion of a split ring or detent.

In an embodiment, the trailing receiving portion further comprises a detent groove positioned along an inner wall thereof that defines the internal cavity for receiving the bit body, the detent groove configured to engage and retain a detent of the bit body in the detent groove of the cutting head.

In an embodiment, the cutting head further comprises a second internal cavity adapted to receive a pin member of a retaining arrangement therein.

In an embodiment, the second internal cavity is located within the cutting tip of the cutting head.

In an embodiment, the internal cavity and the second internal cavity are open cavities.

In an embodiment, the second internal cavity is directly connected to the internal cavity.

In another aspect, the invention provides a method of replacing a cutting head of a drill bit assembly, the method including the step of: removably coupling a bit body to a cutting head by locating an end of the bit body within an internal cavity of a trailing receiving portion of the cutting head, wherein the cutting head is removably coupled to the bit body by a retaining arrangement.

In an embodiment, the step of removably coupling the bit body to the cutting head further includes effecting relative axial movement between the cutting head and the bit body such that the trailing receiving portion of the cutting head receives the end of the bit body and the axial movement results in a detent assembly removably coupling the bit body to the cutting head.

In an embodiment, the method further includes the step of engaging a detent groove of the detent assembly positioned along an inner wall of the trailing receiving portion that defines the internal cavity of the cutting head for receiving the end of the bit body with a detent of the detent assembly provided at or adjacent the end of the bit body along an outer wall of the bit body, wherein the axial movement of the receiving portion of the cutting head towards the first end of the bit body results in engagement and retention of the detent within the detent groove.

In an embodiment, the method further includes the step of locating a resiliently biased pin member of the retaining arrangement within a hollow passage of the bit body.

In an embodiment, the method further includes the step of retaining the pin member within the hollow passage of the bit body with a cap member to maintain the cutting head in an inter-locked position with the bit body.

In an embodiment, the method further includes the steps of: moving the cap member axially toward the cutting head thereby pushing the pin member into a second internal cavity of the cutting head and aligning a notch of the pin member with the detent; and applying a pulling force on the cutting head away from the bit body thereby causing walls of the detent groove to push the detent into the notch and release the bit body from the cutting head.

In an embodiment, the cap member comprises a grub screw.

In an embodiment, the cutting head is a second cutting head, and the method further includes the step of decoupling the bit body from a first cutting head before coupling the bit body to the second cutting head.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary in any way. The Detailed Description will make reference to a number of drawings as follows.

DETAILED DESCRIPTION

Figure 1:
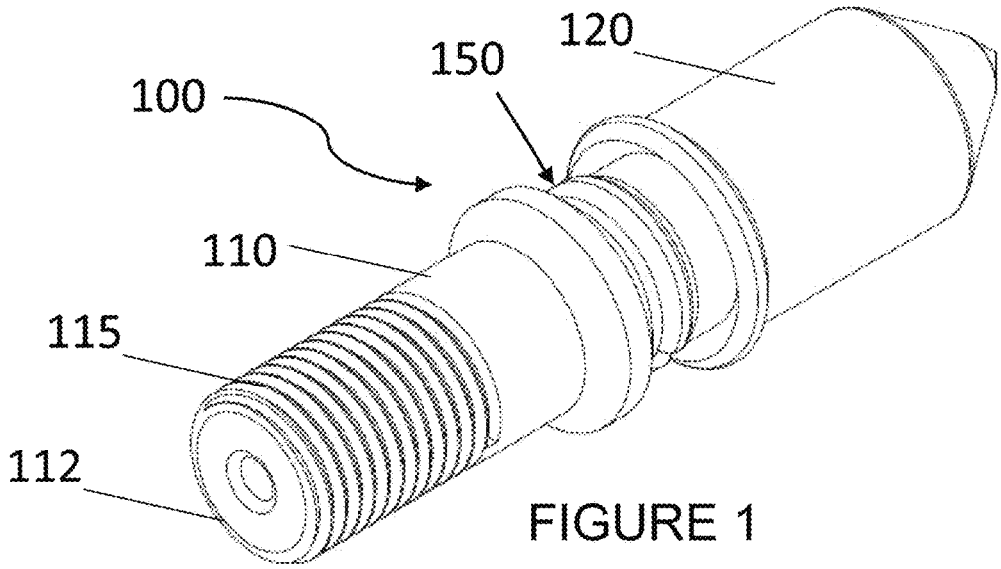
FIG. 1 is a perspective view of a drill bit assembly 100 in accordance with a first embodiment shown in a coupled configuration.
Figure 2:
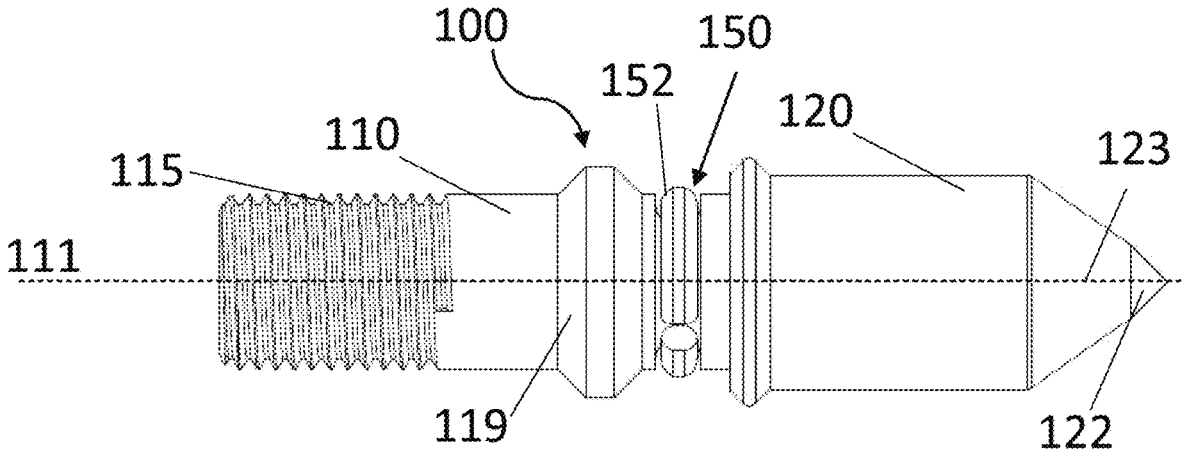
FIG. 2 is a side view of the drill bit assembly 100 in a coupled configuration.
Figure 3:
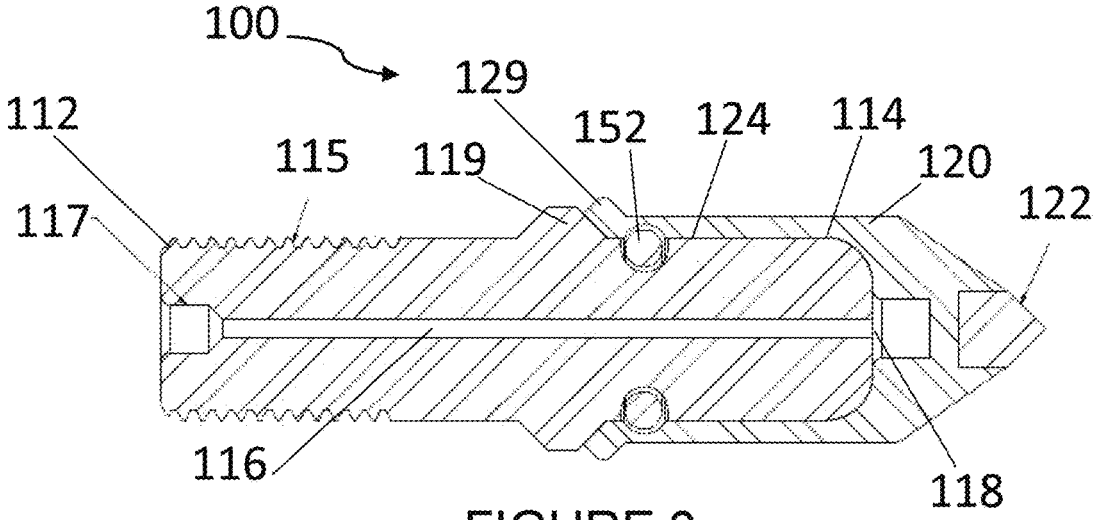
FIG. 3 is a sectional view of the drill bit assembly 100 in a coupled configuration.
Figure 4:
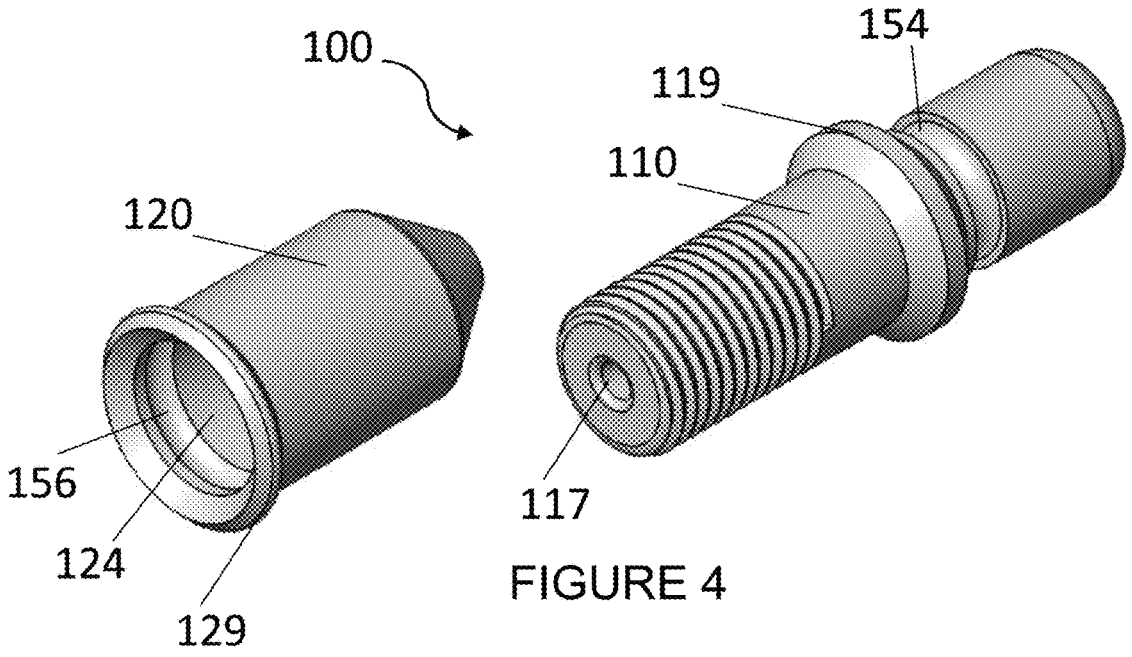
FIG. 4 is an exploded perspective view of the drill bit assembly 100 in an uncoupled configuration.
Figure 5:
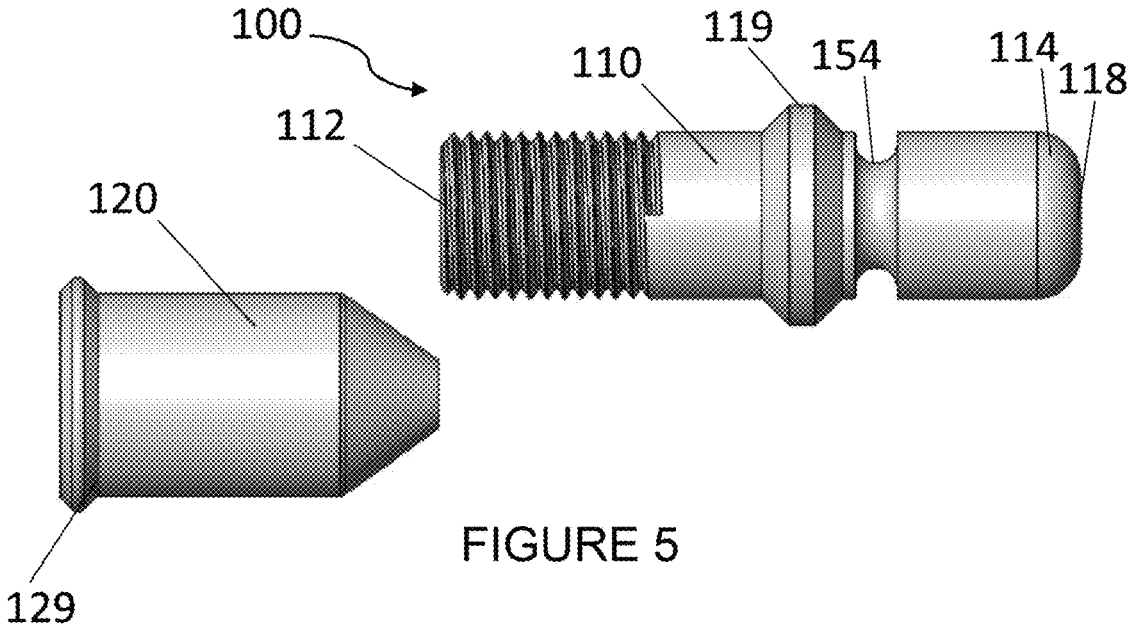
FIG. 5 is an exploded side view of the drill bit assembly 100 in an uncoupled configuration.
Figure 6:
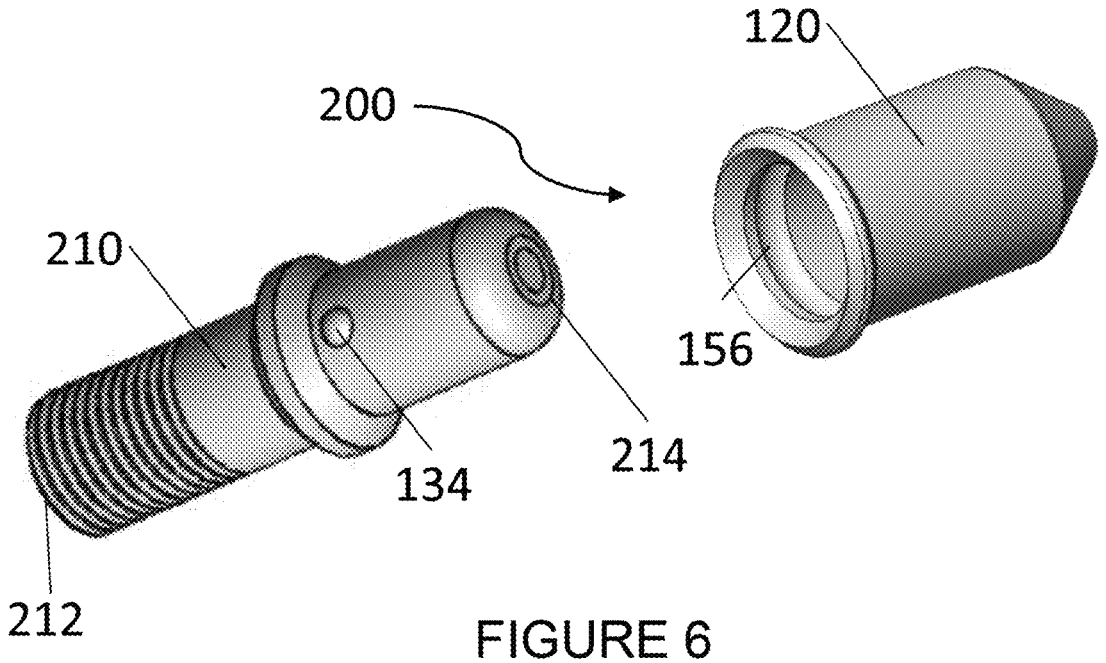
FIG. 6 is an exploded perspective view of a drill bit assembly 200 in accordance with a second embodiment in an uncoupled configuration.
Figure 7:
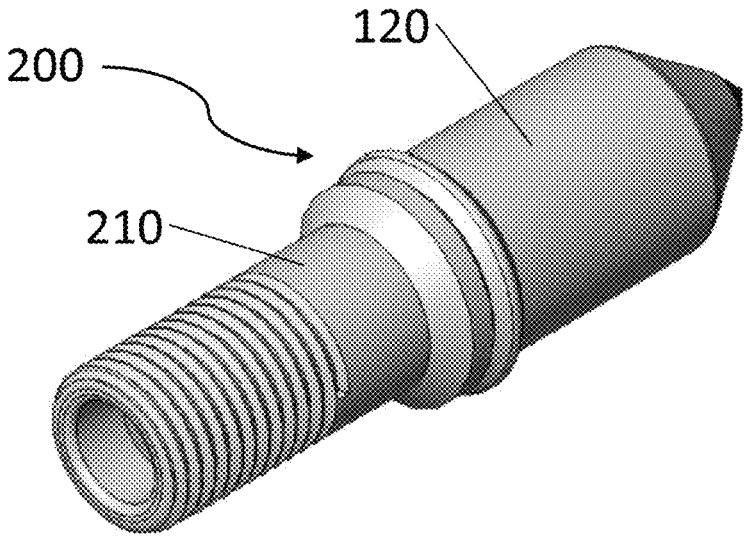
FIG. 7 is a perspective view of a drill bit assembly 200 shown in a coupled configuration.

Embodiments of the drill bit assemblies 100 or 200, as described in the following passages, provide significant advantages and benefits over other devices and methods for boring through earth, concrete and other hard materials. However, the recited advantages are not meant to be limiting in any way, as one skilled in the art will appreciate that other advantages may also be realized upon practicing the invention.

FIGS. 1 to 5 illustrate a drill bit assembly 100 in accordance with a first embodiment of the present invention and include a bit body 110 extending between a first end 112 and a second end 114 along a longitudinal axis 111 of the bit body 110. At the first end 112, helical threads 115 are provided for allowing the body 110 to be coupled to a rotating shaft (not shown) that is coupled to a rotation means for providing rotary torque or force to the drill bit assembly 100, such as a topside motor, a downhole motor, an engine, turbine, or other type of drive that also located near the surface, or some other rotation means.

The second end 114 of the bit body 110 is removably coupled to a cutting head 120 that includes a leading cutting tip 123 comprised of polycrystalline diamond material that is provided in the form of a PDC insert 122 positioned in an exposed portion of the cutting tip 123 to assist with cutting into earth or other hard materials. While the cutting tip 122 in the example drill bit assembly 100 of FIGS. 1 to 5 is a PDC insert, it should be clearly understood that other types of cutting elements such as cubic boron nitride, or other super hard material, or hard material such as a metal carbide, may also be used in a bit made according to the invention. The cutting head 120 comprises a substantially frusto-conical configuration with the PDC tip forming an apex portion of the tip in the cutting head 120.

The cutting head 120 also includes a trailing receiving portion 124 for receiving the second end 114 of the bit body 110 into an internal cavity 126 defined by the receiving portion 124 to allow the cutting head 120 to be removably coupled to the second end 114 of the bit body 110.

A retaining arrangement 150 is provided to retain the second end 114 of the bit body 110 in the receiving portion 124 of the cutting head 120. Detailed views of the retaining arrangement have been shown in FIGS. 3, 4 and 5 which clearly illustrate that the retaining arrangement 150 comprises a split ring member 152 wherein an inner portion of the split ring member 152 is adapted to be positioned and engaged in an outer groove 154 (See FIGS. 4 and 5) provided along an outer wall of the bit body 110 and an outer portion of the split ring 152 is adapted to engage an inner groove 156 (See FIGS. 4 and 5) provided along an inner wall of the receiving portion 124 of the cutting head 120. The split ring 152 is in the form of a ring shaped member with first and second circumferential end points that do not connect and the circumference of the split ring member is slightly lesser than the circumference of the outer groove 154 of the bit body 110.

The provision of the split ring 152 allows for the cutting head 120 to be push fitted onto the bit body 110 by effecting relative axial movement between the cutting head 120 and the bit body 110 such that the receiving portion 124 of the cutting head 120 receives the second end 114 of the bit body 110 and the axial movement results in the inner groove 156 of the cutting head 120 being positioned in engagement with the split ring 152 by pushing onto the split ring 152 causing the circumferential ends of the split ring 152 to move closer and snap onto the outer groove 154 of the bit body 110. This action results in the second end 114 of the bit body 110 being retained in the receiving portion 124 of the cutting head 120.

The configuration of the spit ring 152 and the positioning of the outer groove of the bit body 154 and the inner groove 156 of the cutting head 120 allows the cutting head 120 to freely rotate relative to the bit body 110. The split ring 152 therefore provides a bearing arrangement to enable relative rotational movement between the bit body 110 and the cutting head 120.

The cutting head 120 also includes a profiled stop member 129 that is positioned along an outer wall of the bit body 110 to limit axial movement of the receiving portion 124 of the cutting head 120 towards the first end 112 of the bit body 110. In order to assemble the drill bit assembly 100, an operator would be required to effect axial movement of the cutting head 120 towards the bit body 110 in order to align the inner groove 156 of the cutting head 120 with the outer groove 154 thereby resulting in applying a pushing force onto the split ring 152 which results in the cutting head 120 being snap fitted onto the receiving portion 124 of the bit body 110. Such axial movement of the cutting head 120 results in the profiled stop member 129 on the cutting head 120 abutting the circumferential collar member 119 provided along an outer wall of the bit body 110 thereby limiting the extent of relative axial movement between the cutting head 120 and the bit body 110 when the second end 114 of the bit body 110 is received into the internal cavity of the receiving portion 124 of the cutting head 124. The aforementioned arrangement allows the cutting head 120 to be uncoupled from the bit body 110 by application of a pulling force on the cutting head 120 to pull the cutting head 120 in an axial direction away from the first end 112 of the bit body 110.

The bit body 110 also includes a bore 116 extending from the first end 112 to the second end 114 along the longitudinal axis of the bit body 110. The bore 116 is provided to convey a lubricant from the first end 112 to the second end 114 of the bit body 110. A filling lubricant nipple 117 is positioned at the first end 112 of the bit body 110 and a release nipple 118 is positioned at the second end 114 of the bit body 110. The release nipple 118 is arranged to release the lubricant into an internal cavity 121 of the cutting tip thereby lubricating the bearing surfaces 125 of the second end 114 of the bit body 110 and internal bearing surfaces of the cutting tip 120.

Referring to FIGS. 6 to 9, a drill bit assembly 200 in accordance with a second embodiment of the present invention has been illustrated. Like reference numerals denote like features that have been previously described in the earlier sections. The main difference between the drill bit assembly 200 and the previously described drill assembly 100 relates to the configuration of the bit body 210 which is different from the bit body 110 described in the earlier sections. Furthermore, a release pin 250 that is housed within the bit body 210 provides a mechanical arrangement to allow the cutting head 120 to be released from a bit body 210 as will be described in the foregoing sections.

The bit body 210 also extends between a first end 212 and a second end 214. The cutting head 120 is detachably coupled or interlocked to the second end 114 of the bit body 210 by way of a detent assembly 130. The detent assembly 130 comprises: a detent groove 156 positioned along an inner wall 127 that defines the internal cavity of the receiving portion 124 for receiving the second end 214 of the bit body 210. A detent ball 134 is provided adjacent the second end 214 of the bit body 210 along an outer wall of the bit body 210. One of the problems addressed by the drill assembly 200 relates to easily replacing the cutting head 120 whilst also reducing maintenance times. Axial movement of the receiving portion 124 of the cutting head 120 towards the first end 212 of the bit body 210 results in engagement of the detent ball 134 with the detent groove 156 thereby catching the detent ball 134 and retaining the cutting head 120 in a coupled configuration with the second end 114 of the bit body 110. Therefore the detent assembly 130 provides a retaining arrangement to retain the second end 114 of the bit body 210 in the receiving portion 124 of the cutting head 120.

The cutting head 120 also includes the profiled stop member 129 that is positioned along an outer wall of the bit body 110 to limit axial movement of the receiving portion 124 of the cutting head 120 towards a first end 212 of the bit body 210. Axial movement of the cutting head 120 results in the profiled stop member 129 abutting a circumferential collar member 219 provided along an outer wall of the bit body 210 thereby limiting the extent of relative axial movement between the cutting head 120 and the bit body 210 when the second end 214 of the bit body 210 is received into the internal cavity of the receiving portion 124 of the cutting head 124.

Figure 8:
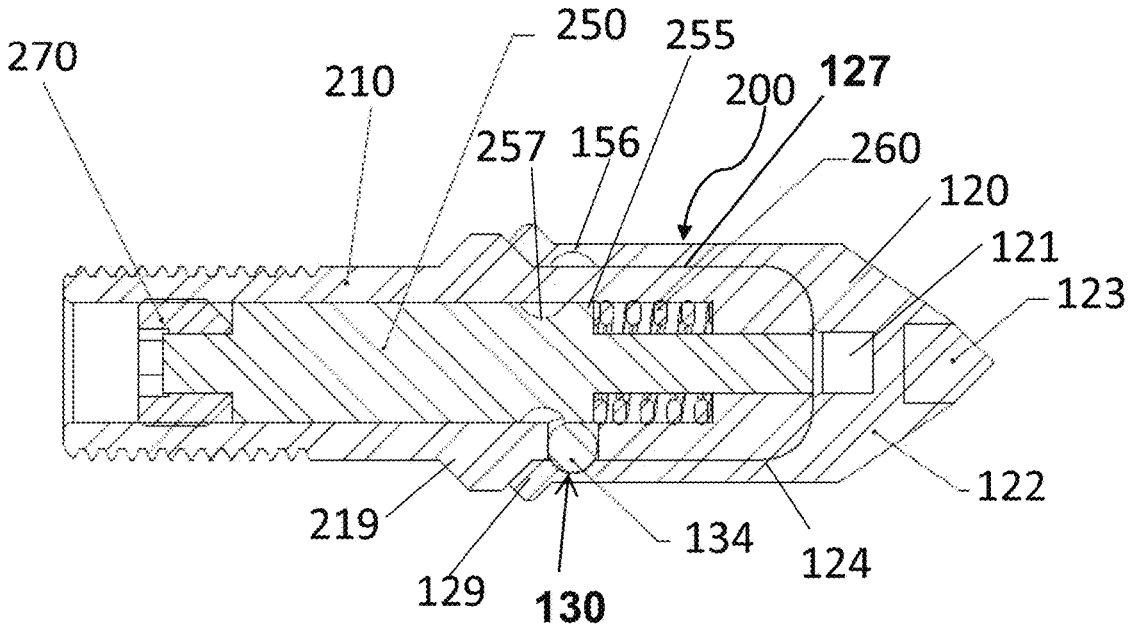
FIG. 8 is a sectional view of the drill bit assembly 200.
Figure 9:
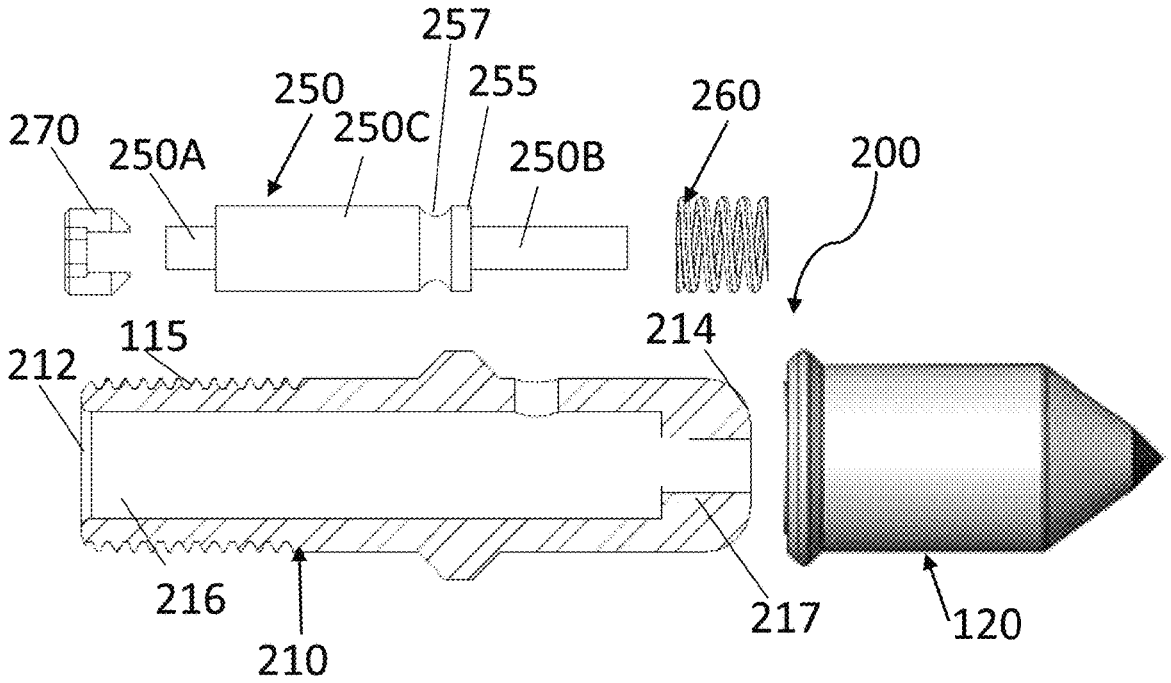
FIG. 9 is an exploded sectional view of the drill bit assembly 200.

Referring to FIGS. 8 and 9, the bit body 210 comprises a hollow passage 216 that extends between the first and second ends 212 and 214. The hollow passage 216 is configured for receiving the spring loaded pin member 250 that allows for the cutting head 120 to be released from the bit body 210. The pin member 250 is biased by a spring member 260 (that urges against the pin member 250 as will be explained in the foregoing sections) for movement towards the first end 212 of the bit body 110. A cap member 270 is provided to retain the release pin member 250 within the hollow passage 216 of the bit body 210 and limit axial movement of the release pin member 250 in a direction towards the first end 212 of the bit body 210.

The configuration of the pin member 250 in combination with the spring member 260 and the shape of the hollow passage 216 enables the cutting head 120 to be mechanically released from the bit body 210 and allows the cutting head 120 to be easily replaced. Referring to FIG. 9, the pin member 250 includes a head portion 250A adapted to be positioned adjacent the first end 212 of the bit body 210; a tail portion 250B adapted to be positioned adjacent the second end 214 of the bit body 210; and a pin body portion 250C extending between the head and tail portions 250A and 250B of the pin member 250. The tail portion 250B is narrower than the pin body portion 250 C and helps accommodate the resilient spring member 260 in between outer walls of said tail portion 250B of the release pin member 250 and inner walls of the bit body 210 defining said hollow cavity/passage 216. In a neutral configuration, the spring member 260 urges against a shoulder portion 255 of the pin body 250C to apply the resilient bias on the pin 250. The hollow passage 216 includes a narrower constricted portion 217 extending towards the second end 214 of the bit body 210.

The aforementioned configuration of the release pin member 250 provides a mechanical arrangement that allows the cutting head 120 to be easily uncoupled from the bit body 210. A cap member in the form of a grub screw 270 is provided to act as a stop for the spring loaded pin member 250 and maintain the cutting head 120 in an inter-locked position with the bit body 210. In order to uncouple the bit body 210 from the cutting head 120, the grub screw 270 needs to be moved axially forward by turning the grub screw (270) in order to push the pin member towards the second end 214 of the bit body 210. The inward pushing of the pin member 250 by turning the grub screw 270 results in the narrower tail portion 250B being inserted into an internal cavity 121 (See FIG. 8). The pin body 250C includes a notch 257 positioned along the outer wall of the pin body 250C such that the axial movement of the pin member 250 towards the second end 214 of the bit body 210 results in the notch 257 being axially displaced and become positioned adjacent the detent assembly 130. Once the notch is aligned with the detent ball 134, an operator may apply a pulling force on the cutting head 120. The pulling of the cutting head 120 causes the walls of the detent groove 156 to push the detent ball 134 into the notch 257 (which is positioned in alignment with the detent ball 134 due to the axial displacement of the release pin member 250—by turning the grub screw 270 as discussed earlier.

Once again, the provision of the detent all 134 in combination with the detent groove 156 also allows the cutting head 120 to freely rotate relative to the bit body 210. The detent arrangement 130 therefore also provides a bearing arrangement to enable relative movement between the bit body 210 and the cutting head 120.

It is important to appreciate that the cutting head 120 comprises a configuration that can be used with the bit body 110 or bit body 210 depending on the drilling requirements of the user.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

What is claimed is:

1. A drill bit assembly, comprising:

a bit body defining a central bore having a first diameter at the first end and a smaller second diameter at the second end;

a cutting head adapted to removably couple to the bit body, the cutting head including a leading cutting tip for cutting into earth and a trailing receiving portion for receiving a second end of the bit body in an internal cavity defined by the trailing receiving portion to allow the cutting head to be removably coupled to the second end of the bit body;

a pin member that is receivable within the central bore, the pin member comprising a pin body portion and a head portion having a smaller diameter than the pin body portion, the pin body portion defining a notch;

a resilient member that is positionable about the head portion of the pin member, the resilient member having a smaller diameter than the pin body portion, wherein:

the cutting head defines a second internal cavity adapted to receive the head portion of the pin member;

the trailing receiving portion further comprises an inner groove provided along an inner wall thereof configured to receive a portion of a split ring or detent;

the notch and the inner groove are misaligned when the resilient member is in a neutral position; and the pin body portion is translatable to compress the resilient member to align the notch with the inner groove, thereby causing the split ring or detent to retract into the notch to enable the cutting head to be removed from the bit body.

2. The drill bit assembly of claim 1 wherein the leading cutting tip further comprises a tip portion and the tip portion comprises a polycrystalline diamond compact (PDC) material.

3. The drill bit assembly of claim 2, wherein the leading cutting tip is substantially frusto-conical.

4. The drill bit assembly of claim 3, wherein the tip portion comprises a PDC insert forming an apex portion of the substantially frusto-conical leading cutting tip.

5. The drill bit assembly of claim 1, wherein the cutting head further comprises a stop member portion to limit axial movement of the trailing receiving portion of the cutting head along the bit body.

6. The drill bit assembly of claim 5, wherein the stop member surrounds an opening of the internal cavity to limit axial movement of the trailing receiving portion of the cutting head along the bit body.

7. The drill bit assembly claim 1, wherein the trailing receiving portion further comprises a detent groove positioned along an inner wall thereof that defines the internal cavity for receiving the bit body, the detent groove configured to engage and retain a detent of the bit body in the detent groove of the cutting head.

8. The drill bit assembly of claim 1, wherein the second internal cavity is located within the cutting tip of the cutting head.

9. The drill bit assembly of claim 8, wherein the internal cavity and the second internal cavity are open cavities.

10. The drill bit assembly of claim 8, wherein the second internal cavity is directly connected to the internal cavity.

11. The drill bit assembly of claim 1, wherein the leading cutting tip is coaxial with the internal cavity and the second internal cavity.

12. A method of replacing a cutting head of a drill bit assembly, the method comprising:

decoupling a bit body from a first cutting head by axially translating a pin body portion of a first pin member received within the bit body to compress a resilient member disposed between an axial surface of the pin body portion and an interior surface of the bit body and to align a notch defined by the pin body portion with an inner groove formed within the first cutting head such that a split ring or detent securing the bit body and the first cutting head moves into engagement with the notch to enable the first cutting head to be slid out of engagement with the bit body; and removably coupling the bit body to a second cutting head by locating an end of the bit body within an internal cavity of a trailing receiving portion of the second cutting head, wherein the second cutting head is removably coupled to the bit body by a retaining arrangement, wherein the step of removably coupling the bit body to the second cutting head further comprises:

effecting relative axial movement between the second cutting head and the bit body such that the trailing receiving portion of the second cutting head receives the end of the bit body and the axial movement results in a detent assembly removably coupling the bit body to the second cutting head; and inserting a resiliently biased second pin member of the retaining arrangement through a hollow passage defined in the bit body such that a tail portion of the pin member extends beyond an end of the bit body and is received within a second internal cavity defined by the second cutting head.

13. The method of claim 12, further comprising the step of engaging a detent groove of the detent assembly positioned along an inner wall of the trailing receiving portion that defines the internal cavity of the second cutting head for receiving the end of the bit body with a detent of the detent assembly provided at or adjacent the end of the bit body along an outer wall of the bit body, wherein the axial movement of the receiving portion of the second cutting head towards the end of the bit body results in engagement and retention of the detent within the detent groove.

14. The method of claim 12, further comprising the step of retaining the second pin member within the hollow passage of the bit body with a cap member to maintain the second cutting head in an inter-locked position with the bit body.

15. The method of claim 14, further comprising the steps of:

moving the cap member axially toward the second cutting head thereby pushing the second pin member into a second internal cavity of the second cutting head and aligning a notch of the second pin member with the detent; and applying a pulling force on the cutting head away from the bit body thereby causing walls of a detent groove of the detent assembly to push the detent into the notch of the second pin member and release the bit body from the second cutting head.

16. The method of claim 14, wherein the cap member comprises a grub screw.

17. The method of claim 12, wherein the first pin member and the second pin member are the same.

18. The method of claim 12, wherein the first pin member and the second pin member are different.

* * * * *